United States Patent [19]

Acker

[11] 4,068,238

[45] Jan. 10, 1978

[54] ELASTIC STRAIN ENERGY DEPLOYABLE HELICAL ANTENNA

[75] Inventor: Roy M. Acker, Los Angeles, Calif.

[73] Assignee: TRW Inc., Redondo Beach, Calif.

[21] Appl. No.: 685,950

[22] Filed: May 13, 1976

[51] Int. Cl.[2] ..... H01Q 1/36

[52] U.S. Cl. ..... 343/895

[58] Field of Search ..... 343/880, 895, 705, 708, 343/DIG. 2

[56] References Cited

U.S. PATENT DOCUMENTS

| | | | |
|---|---|---|---|
| 3,524,190 | 8/1970 | Killion et al. | 343/880 |
| 3,699,585 | 10/1972 | Morrison | 343/895 |
| 3,858,220 | 12/1974 | Arnow | 343/895 |
| 3,913,109 | 10/1975 | Owen | 343/880 |

FOREIGN PATENT DOCUMENTS

| | | |
|---|---|---|
| 810,325 | 12/1936 | France. |

*Primary Examiner*—Eli Lieberman

*Attorney, Agent, or Firm*—John J. Connors; Donald R. Nyhagen; Jerry A. Dinardo

[57] ABSTRACT

An elastic strain energy deployable helical antenna having a tubular resiliently flexible antenna element of relatively flat oval cross-section fixed at one end to a support and formed into a normally extended, resiliently compressible helix with the major axis of the oval cross-section of the element substantially normal to the longitudinal axis of the helix, and flexible tension members of shorter overall length than the fully extended length of the helix fixed at one end to the support and extending axially of the helix across and secured to its helical turns. The antenna helix is compressible axially to a contracted length for storage and is deployable axially by stored elastic strain energy to an extended operating length at which the tension members are stressed in tension by the helix to reinforce the latter against deflection laterally of its longitudinal axis. The tension members may have rigid portions between the helix turns for increasing the natural frequency of vibration of the antenna.

8 Claims, 4 Drawing Figures

ELASTIC STRAIN ENERGY DEPLOYABLE HELICAL ANTENNA

BACKGROUND OF THE INVENTION

1. Field

This invention relates generally to antennae and more particularly to a novel collapsible, elastic strain energy deployable helical antenna.

2. Prior Art

Helical antennas are widely used and their operating characteristics are well understood and hence need not be elaborated on.

Some helical antennas are designed to remain permaently fixed in their normal operating configuration. on the other hand, many applications require a deployable helical antenna, that is, a helical antenna which may be contracted to a collapsed configuration and extended to a deployed operating configuration. Examples of such deployable helical antennas are shown in U.S. Pat. Nos. 3,192,529; 3,524,193; 3,699,585; 3,836,979; 3,737,912; 3,129,427; and 1,106,945.

Designing a helical antenna having the capability of contraction and deployment presents certain problems whose severity increases with wavelength. These problems stem from the relationship between the overall helix diameter and cross-sectional diameter of the helical conductor or radiator and wavelength. In this regard, it is known that the optimum overall diameter of a helical antenna radiator is on the order of 0.3 times the center frequency wavelength. The optimum cross-sectional diameter of the helical conductor or radiator is on the order of 0.006 times this center frequency wavelength. At longer wavelengths, the above relationships yield helix dimensions which are too large for utilization of conventional helical antenna designs and deployment techniques.

Consider, for example, a helical antenna designed for a frequency of 120 $MH_z$, corresponding to a wavelength of 8.5 feet. For this frequency and wavelength, the antenna helix should have an overall diameter of 2.5 feet, a length of 14 feet, and a helix cross-sectional diameter of 0.6 inches. Needless to say, a helix with these dimensions is ill-suited to use in a conventional deployable helical antenna, due in large part to the extreme stiffness of the helix resulting from its relatively large cross-sectional diameter. As a consequence of the foregoing factors, the existing deployable helical antennas are limited to relatively small helix elements and hence to relatively high frequencies.

SUMMARY OF THE INVENTION

This invention provides a novel collapsible, elastic strain energy deployable helical antenna which overcomes many of the problems associated with the design of deployable helical antennae. The antenna of the invention has a resilient tubular antenna element of relatively flat, oval cross-section coiled into the shape of a helix with the major transverse axis of its oval cross-section substantially normal to the longitudinal axis of the helix. This antenna helix is yieldably biased to extend axially by elastic strain energy to a given fully extended length and is compressible axially to a contracted length for storage. One end of the helix is fixed to a support.

Extending axially of and spaced circumferentially about the helix are a number of flexible tension members of shorter overall length than the fully extended length of the helix. These tension members are secured at one end to the antenna support and are fixed at intervals to the turns of the antenna helix.

The tension members flex during axial compression of the antenna helix to permit compression of the helix to its contracted length for storage. When released for axial deployment, the helix extends by elastic strain energy until the tension members becomes taut and resist further extension. This extended length or configuration of the helix is its operating configuration. In this operating configuration, the tension members are stressed in tension by the residual elastic strain energy in the antenna helix and reinforce the helix against lateral deflection. The tension members may have rigid portions between adjacent turns of the helix to increase the natural frequency of vibration of the antenna.

The use of a tubular antenna element achieves the desired element cross-section for proper antenna operation with a relatively lightweight antenna construction. The oval cross-section of this tubular antenna element and the orientation of the major axis of the oval cross-section normal to the longitudinal axis of the helix permits axial compression of the helix without excessive torsional stress and permanent deformation of the element.

DESCRIPTION OF THE PREFERRED EMBODIMENTS

Figure 1:
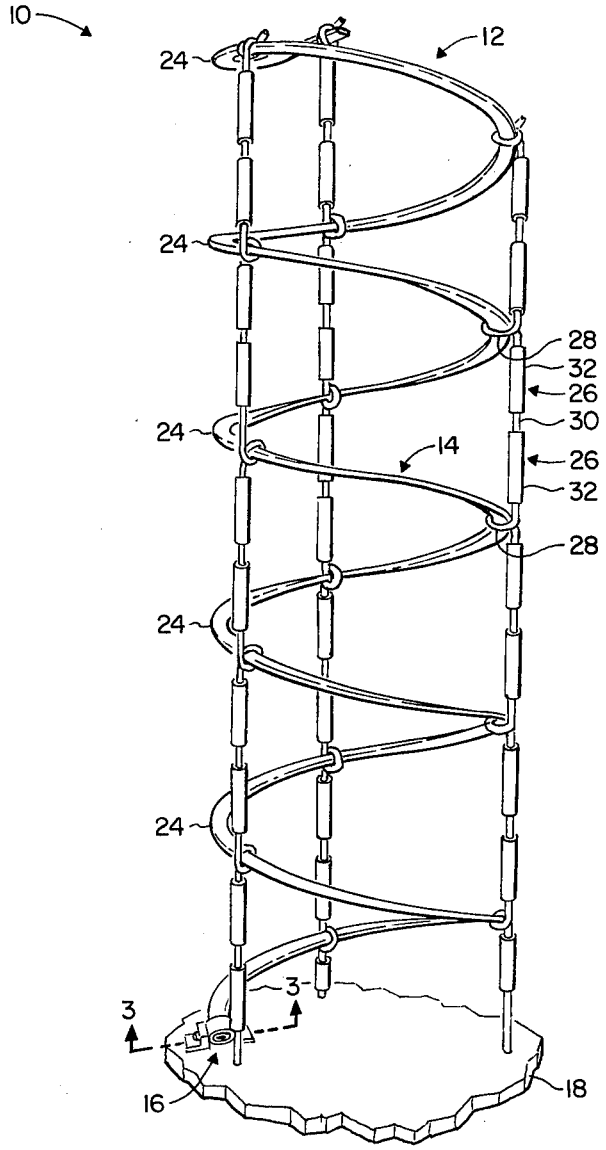
FIG. 1 is a perspective view of a helical antenna according to the invention in its extended or deployed configuration.

The illustrated elastic strain energy deployable helical antenna 10 has a resiliently flexible antenna element 12 formed into a helix 14. one end of this helix is secured by means 16 to a support 18. According to one feature of the invention, antenna element 12 comprises an electrically conductive tube of suitable elastic or resilient material, such as with a relatively flat oval cross-section in transverse planes containing the longitudinal axis of the helix. The major axis 20 of this oval cross-section is substantially normal to the helix axis.

Antenna helix 14 is yieldably biassed to extend or deploy axially away from the antenna support 18 by stored elastic strain energy to a fully extended length. The helix is compressible axially toward the support to a contracted length or configuration (FIG. 2) for storage. This compression or contraction of the helix stores or creates within the antenna element 12 elastic strain energy for extending the helix toward its fully extended length when the helix is released.

Extending axially of and spaced circumferentially about the antenna helix 14 are a number, in this case three, flexible tension members 22. Tension members 22 are fixed at one end to the antenna support 18 and at intervals to the helical turns 24 of the helix. In the particular antenna embodiment illustrated, the tension members are flexible cords of nylon or other suitable material which are secured to the helix turns 24 by looping the cords around the turns, as shown, and bonding or otherwise attaching the cord loops to the turns.

Tension members 22 have an overall length less than the fully extended length of the antenna helix 14. Accordingly, these members limit elastic strain energy extension or deployment of the helix to a length or configuration (FIG. 1) at which the members become sufficiently taut to resist further extension of the helix to its fully extended length. This extended or deployed length to which the helix is limited by the tension members is its operating length. When extended to this operating length or configuration, the antenna helix is not fully extended and hence contains some residual stored elastic strain energy which stresses the tension members in tension.

Tension members 22, when thus tensioned by the residual elastic strain energy in the deployed antenna helix 14, reinforce the helix against lateral deflection. The natural frequency of vibration of the antenna, which may be critical in some applications, can be increased by increasing the tension loading on the tension members in the deployed operating configuration of the antenna helix. This is accomplished by increasing the residual elastic strain energy in the helix when in its operating configuration.

Another and preferred method of increasing the natural frequency of vibration of the antenna involves providing the tension members 22 with relatively rigid portions 26 between the adjacent turns 24 of the antenna helix 14. In the particular embodiment shown, the tension members have flexible portions 28 secured to the turns, a pair of rigid portions 26 between each pair of adjacent turns, and a flexible portion 30 between each pair of rigid portions. Each rigid portion 26 is formed by a relatively rigid sleeve 32 surrounding and bonded or otherwise secured to the tension member cord.

Figure 2:
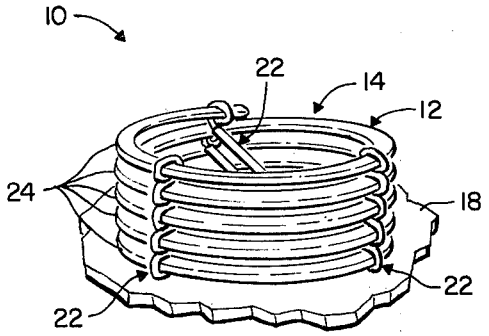
FIG. 2 is a perspective view of the antenna in its contracted or stowed configuration.
Figure 4:
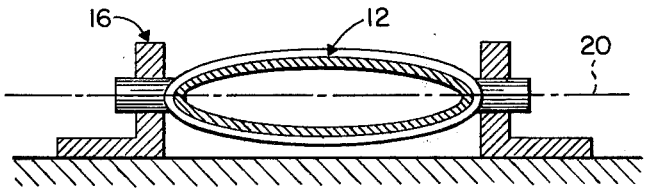
FIG. 4 is an enlargement of a flexible tension member embodied in the antenna.
Figure 3:
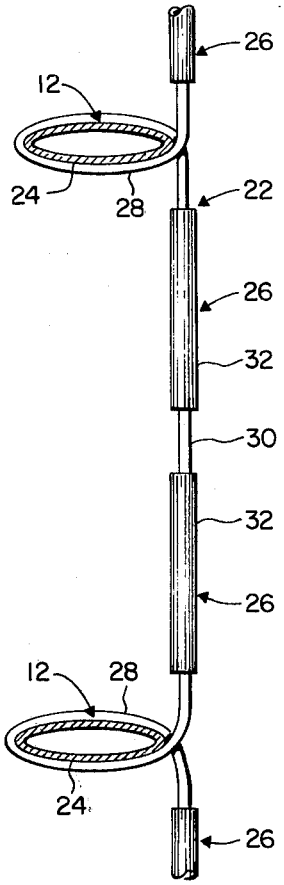
FIG. 3 is an enlarged section taken on line 3—3 in FIG. 1.

It will now be understood that the helical antenna 10 is compressible axially to its contracted length or configuration of FIG. 2 for storage. Any suitable means (not shown) may be utilized for releasibly retaining the antenna in this storage configuration. When released, the antenna extends or deploys axially by stored elastic strain energy to its deployed operating length or configuration of FIG. 2. In this operating configuration, the tension members or cords 22 are loaded in tension by the residual stress or elastic strain energy in the antenna helix 14 to reinforce the latter against lateral deflection. The helix attaching means 16 provides an electrical connection for attaching an antenna lead to the helix.

A typical helical antenna according to the invention may have the following dimensions and parameters:

Helix Material: 6061T6 aluminum alloy
Oval Cross-section of Antenna Element 12: 0.150 height, 0.689 width, and .015 thick
Helix Diameter: 13.0 inches
Helix Length Contracted: 9.0 inches
Helix Length Deployed: 154 inches

I claim:

1. An elastic strain energy deployable helical antenna comprising:

a resiliently flexible antenna element in the form of a helix which is yieldably biassed to extend axially by elastic strain energy to a given fully extended length and is compressible axially to a contracted length;

said antenna element comprising an electrically conductive tube of relatively flat oval cross-section in transverse planes containing the longitudinal axis of said helix;

the major axis of said oval cross-section in any transverse plane being substantially normal to said longitudinal axis;

a plurality of flexible tension members extending axially of and spaced circumferentially about said helix and secured to helical turns of said antenna element; and said tension members having relatively rigid portions between said turns and an overall length less than said fully extended length, whereby said members limit elastic strain energy extension of said antenna element to an operating length less than said fully extended length and said members are stressed in tension by said element at said operating length to reinforce said element against deflection laterally of said longitudinal axis.

2. A deployable helical antenna according to claim 1 wherein:

each tension member has flexible portions secured to the helical turns of said antenna element and a pair of said rigid portions and an intervening flexible portion between each pair of adjacent turns.

3. A deployable helical antenna according to claim 2 wherein:

said tension members comprise cords.

4. A deployable helical antenna according to claim 3 wherein:

each tension member has relatively rigid sleeves surrounding the respective cord and forming said rigid portions of the member.

5. A deployable helical antenna according to claim 4 including:

an antenna support at one end of said helix secured to the adjacent ends of said antenna element and said tension members.

6. A deployable helical antenna according to claim 1 including:

an antenna support at one end of said helix secured to the adjacent ends of said antenna element and said tension members.

7. An elastic strain energy deployable helical antenna comprising:

a normally extended, axially compressible helix comprising a tubular, resiliently flexible, helically coiled antenna element which is stressed to extend axially by elastic strain energy to a given fully extended length and is yieldably compressible axially to a contracted length;

said antenna element comprising an electrically conductive tube of relatively flat oval cross-section in transverse planes containing the longitudinal axis to said helix; and the major axis of said cross-section in any transverse plane being substantially normal to said longitudinal axis of the helix, whereby said helix is axially compressible to said contracted length without permanent deformation of the helix.

8. A deployable helical antenna according to claim 7 including:

a plurality of flexible tension members circumferentially spaced about said helix and extending axially of said helix directly from one helical turn of the helix to the next and secured to each said helical turn; and said tension members having an overall length less than said fully extended length of said helix, whereby said tension members limit extension of said antenna element to an operating length less than said fully extended length, and said tension members are stressed in tension between the adjacent helical turns at said operating length to reinforce said helix against deflection laterally of its longitudinal axis.

* * * * *